United States Patent [19]

Mesh

[11] 4,078,691

[45] Mar. 14, 1978

[54] SAFETY COVER FOR GAS OUTLET

[76] Inventor: Richard Douglas Mesh, 1404 Westmoreland Dr., Lake Charles, La. 70605

[21] Appl. No.: 810,687

[22] Filed: Jun. 27, 1977

[51] Int. Cl.[2] ..... B65D 25/00

[52] U.S. Cl. ..... 220/85 P; 220/334; 174/67; 138/89

[58] Field of Search ..... 220/85 P, 3.8, 334, 220/339; 174/67; 138/89

[56] References Cited

U.S. PATENT DOCUMENTS

| | | | |
|---|---|---|---|
| 3,185,336 | 5/1965 | Goss | 220/85 P X |
| 4,033,156 | 7/1977 | Cottingham | 220/339 X |

*Primary Examiner*—George T. Hall

*Attorney, Agent, or Firm*—N. Elton Dry

[57] ABSTRACT

A safety cover for a gas outlet comprising a mounting plate for securement to a gas outlet pipe and a cover hinged to the plate whereby the cover may be positioned over the outlet and pivotally moved out of the way to permit access to the gas outlet. Typically, the cover is color-coded to identify the source of gas available at cite of use.

10 Claims, 4 Drawing Figures

SAFETY COVER FOR GAS OUTLET

BACKGROUND OF THE INVENTION

1. Field of the Invention

The present invention is directed to a mechanical safety device for preventing the accidental connection of gas utilization equipment to an improper gas source. In particular, the invention comprises a safety cover for a gas outlet.

2. Description of the Prior Art

In certain industrial work places it is common to have installed permanent industrial-type gas outlet systems. By this means, quantities larger than a single gas cylinder may be used, without accompanying regulator to control gas flow. Typically, the gas is piped to various locations at the work site or shop.

An inherent danger in this approach is that the gas user does not have before him a color-coded gas cylinder. The user may accidentally connect up to nitrogen while intending to connect up to oxygen, or visa versa. The error could be fatal if not caught in time.

No effective prior art devices are known which solve the above safety problem.

SUMMARY OF THE INVENTION

The present invention comprises a safety cover for a gas outlet comprising a mounting plate for securement to a gas outlet pipe and a cover hinged to the plate whereby the cover may be positioned over the outlet and pivotally moved out of the way to permit access to the gas outlet.

In the preferred embodiment, the cover is color coded to indicate type of gas and has indicia on the outer face of the cover indicating type of gas and/or other warnings.

DESCRIPTION OF THE PREFERRED EMBODIMENTS

The invention will be more readily understood from a reading of the following specification and by reference to the accompanying drawings wherein an example of the invention is shown, and wherein.

Figure 3:
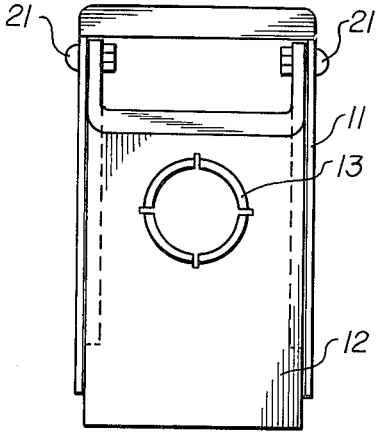

FIG. 3 a plan, rear view of the safety cover, in the closed position; and

Figure 2:
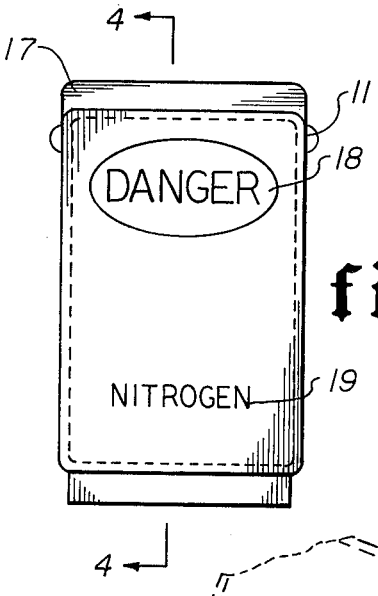
FIG. 2 is a plan, front view of the safety cover, in the closed position, illustrating the indicia appearing on the cover.
Figure 4:
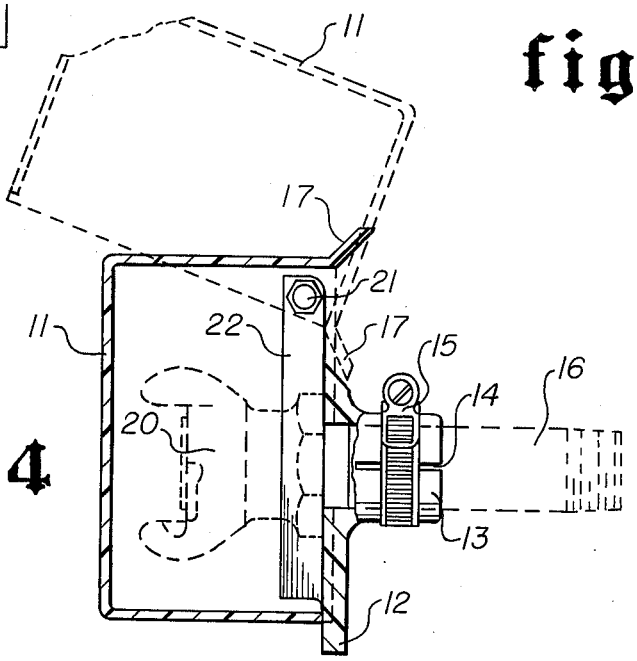

FIG. 4 is a side sectional view along the line 4—4 of FIG. 2, illustrating both the open and closed mode.

Figure 1:
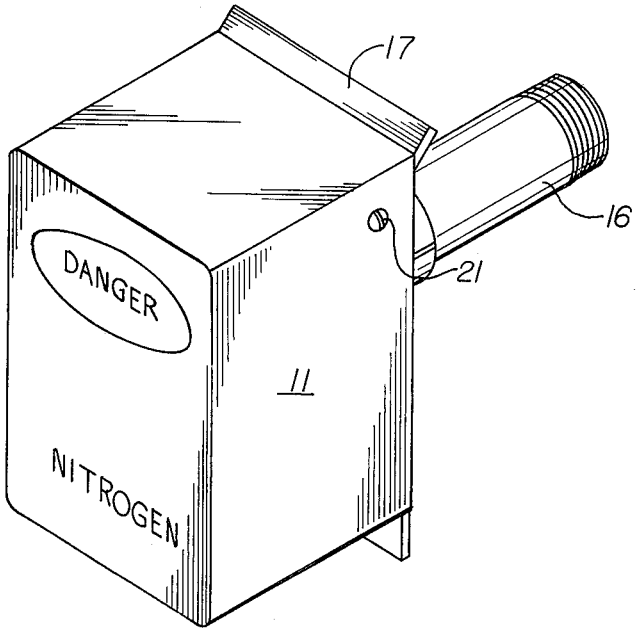
FIG. 1 is a perspective view of a preferred embodiment of the safety cover, shown attached to the gas outlet pipe with the cover in a closed position.

In the drawings, the numeral 11 designates the safety-cover of the present invention, with the numeral 12 designating the mounting plate therefor. FIG. 1 illustrates the over-all configuration of the entire safety cover apparatus, connected to the gas outlet pipe 16. The cover 11 preferably has lip 17 extending upwardly from the rear of the top portion of the cover 11. The purpose of the lip 17 is shown in FIG. 4, where it is shown acting as a stop, limiting the pivotal action of the cover 11 when the cover 11 is rotated upwardly to give access to gas connector 20.

The safety cover 11 pivots on pivoting means 21, shown in the drawings to be a screw. However, the pivoting means may be a rivet, brad or any other device for conveniently accomplishing this function.

FIG. 2 illustrates the front of the safety cover where there in indicia 19 to describe the type of gas available at the gas outlet and any other safety message 18 deemed appropriate relative to the gas or its use. In this example the gas is nitrogen and the safety message 18 is DANGER. For the purpose of the present invention, the indicia may be any message, or none at all, since it is intended that in a preferred embodiment thereof that the cover 11, itself, is color coded in same manner as gas cylinders.

FIG. 3, illustrating the rear position of the gas outlet safety cover, shows the pivoting means 21 and the pipe receiving means 13. The gas pipe 16 is inserted through the pipe receiving means 13, whereby a gas connector 20 is positioned within the cover 11, all of which is more clearly illustrated in FIG. 4.

Referring to FIG. 3, it may be seen that the mounting plate 12 is attached to the cover 11 by means of the pivoting means 21. It is preferred that the upper portion of the mounting plate 12, beginning at a point just above the pipe receiving means 13, comprise upwardly extending parallel members, to which is connected the cover 11. This arrangement permits pivotal rotation of the cover 11 in an upward direction to gain access to the gas connector 20.

Normally, the mounting plate 12 is constructed of a channel shaped extrusion of some material. The gas pipe receiving means 13 is normally attached to the rear surface of the mounting plate 12, over a hole previously cut into the plate 12. Method of attachment depending, of course, on materials of construction. The channel sides extend forward, in the direction of the gas connector 20, as illustrated in FIG. 4.

Two portions of the channel stock are normally cut away. One of these is at the lower end of the mounting plate 12, on the forward side. Enough of the channel wall is removed to permit closure of the cover 11 to where there is a flush contact with the main surface of the mounting plate 12. This is illustrated in FIG. 4.

The second cut is made on the upper portion of the plate 12, just above the pipe receiving means 13, in order to remove the plate portion of the channel, retaining the parallel channel walls in order to attach the cover 11 to the mounting plate 12 by use of the pivot means 21. This cut permits rotation of the cover 11 about the pivot means 21 through about a 110° arc. However, this arc is not critical. All that is required is enough clearance to permit access to the gas connector 20.

The above discussion relative to use of a channel piece, cuts, and the like, are applicable only when the mounting plate is constructed in this manner. It is not a limitation on method of construction. In truth, the entire mounting plate 12 may be molded in one or more pieces in a single step operation, depending entirely on equipment available to one constructing the device of the present invention.

What is illustrated and described in detail, above, is merely the preferred embodiment of the present invention. The shape, while illustrated as being more or less square or rectangular, may in fact be round, oblong or of any configuration desired by a particular manufacturer.

The gas pipe receiving means 13 is preferably scored, as shown at 14, in order to permit contraction of the receiving means 13. This permits a secure mateing of the mounting plate 12 to the pipe 16. Securement may be by a clamp 15, as shown in FIG. 4.

Materials of construction are the choice of the user. However, for ease of construction, it is preferred that the present invention be made from plastics, elastomers, thermosetting materials, metal or combinations of any of these. Use of thermoplastic materials permit use of injection molding equipment. However, choice of material is not critical, but is determined from considerations of cost, weight, ease of construction and durability.

Other modifications of this invention will be readily apparent from the foregoing description of several preferred embodiments and it should be understood that the true scope of this invention is defined by the appended claims.

I claim:

1. A safety cover for a gas outlet comprising, in combination, a mounting plate for securement to a gas outlet pipe, the mounting plate having a pipe receiving means, and a cover connected to the mounting plate whereby the cover may be positioned over the gas outlet pipe and pivotally moved out of the way to permit access to the gas outlet pipe.

2. The safety cover of claim 1, wherein the cover is color coded to indicate a particular type of gas.

3. The safety cover of claim 2, wherein the cover has indicia on the outer face thereof indicating type of gas.

4. The safety cover of claim 1, wherein the mounting plate comprises:

(a) U-shaped channel member having a top and a bottom and wall members extending forward of a flat plate;

(b) on the rear of the plate, extending outwardly, a gas pipe receiving means for securement of the mounting plate to a gas pipe; and (c) at the top of the mounting plate means for securing thereto the cover, whereby the cover may be pivoted upwardly about the cover securing means.

5. The safety cover of claim 4, wherein there extends above the flat plate the wall members, the cover being secured to said upwardly extending wall members.

6. The safety cover of claim 1, wherein the cover is a rectangular box-like structure.

7. The safety cover of claim 1, wherein there is attached to the cover, on the top wall thereof and extending in the direction of the mounting plate and beyond, a stop means whereby the cover is stopped from being pivoted beyond a certain point when the stop means makes contact with the rear of the mounting plate.

8. The safety cover of claim 4, wherein the cover securing means comprises a nut and screw combination.

9. The safety cover of claim 1, wherein the mounting plate and cover are polymeric.

10. The safety cover of claim 1, wherein the mounting plate and cover are metal.

* * * * *